US005993728A

United States Patent [19]

Vild

[11] Patent Number: 5,993,728

[45] Date of Patent: Nov. 30, 1999

[54] GAS INJECTION PUMP

[75] Inventor: Chris T. Vild, Cleveland Heights, Ohio

[73] Assignee: Metaullics Systems Co., L.P., Solon, Ohio

[21] Appl. No.: 08/900,433

[22] Filed: Jul. 25, 1997

Related U.S. Application Data

[60] Provisional application No. 60/022,671, Jul. 26, 1996.

[51] Int. Cl.[6] ..... C22B 9/05

[52] U.S. Cl. ..... 266/217; 266/235; 75/681

[58] Field of Search ..... 266/217, 235; 75/680, 681

[56] References Cited

U.S. PATENT DOCUMENTS

| | | | |
|---|---|---|---|
| 1,914,919 | 6/1933 | Heermans . | |
| 2,905,093 | 9/1959 | Raub . | |
| 3,048,117 | 8/1962 | Franzen . | |
| 3,139,264 | 6/1964 | Queneville . | |
| 4,052,199 | 10/1977 | Mangalick . | |
| 4,295,883 | 10/1981 | Lajh | 75/680 |
| 4,351,514 | 9/1982 | Koch . | |
| 4,789,301 | 12/1988 | Osborne . | |
| 4,861,352 | 8/1989 | Cheng | 75/680 |
| 5,135,202 | 8/1992 | Yamashita . | |
| 5,203,681 | 4/1993 | Cooper . | |
| 5,340,379 | 8/1994 | Tremblay . | |
| 5,662,725 | 9/1997 | Cooper | 75/680 |

OTHER PUBLICATIONS

Hopkins et al Quantification of Molten Melal Quality "Improvements Using an L–Series Gas Injection Pump" 3rd *International Symposium on Recyl. of Metals & Eng Mgt.* The Minerals Metals & Materials Society No Month 1995, pp. 31–34.

*Primary Examiner*—Melvyn Andrews
*Attorney, Agent, or Firm*—Fay, Sharpe, Fagan, Minnich & McKee, LLP

[57] ABSTRACT

An apparatus for treating molten aluminum or zinc having a housing providing a chamber for containing a molten metal. The chamber including an inlet opening and an outlet passage. A rotatable impeller disposed within the chamber for drawing molten metal in through the inlet and expelling molten metal through the outlet passage. A convergent nozzle being positioned in the outlet passage. A gas injection conduit having an inlet in fluid communication with a source of purifying gas and an outlet in proximity to the chamber, and positioned upstream of the nozzle.

14 Claims, 4 Drawing Sheets

GAS INJECTION PUMP

CROSS REFERENCE TO RELATED APPLICATION

This application is a continuation of U.S. Provisional Application 60/022,671, filed Jul. 26, 1996.

BACKGROUND OF THE INVENTION

In the non-ferrous metals industry, scrap recycling has become a way of economic life. In fact, long before environmental concerns and conservation began to drive scrap recycling efforts, recycling of aluminum, copper, zinc, lead and tin has occupied a firm nitch in the marketplace.

In the aluminum recycling industry in particular, refining processes are complicated greatly by the potency of aluminum to oxidize quite readily. Consequently, refining by oxidating reactions alone, common for other non-ferrous metals, is not feasible. Similarly, aluminum has exceptionally strong alloying characteristics with a variety of other metals, therefore, a broad range of metallic impurities must often be removed during processing. Along these lines, the removal of magnesium has become a particular focus within the industry. The ability to remove magnesium from molten aluminum is made possible by a favorable chemical reaction between manganese and chlorine as described herein below.

Although the molten aluminum must be treated, the ultimate goal in the aluminum cast house is to maintain and/or continuously improve product quality while pushing the production rate upward. Some of the key factors which are monitored to meet product quality requirements include metallurgical composition (alkali impurities), inclusion levels, and gas content.

In the production scheme, the charging process occurring in the melting furnace, takes up a large majority of the overall time. The focus of this invention is to provide an improved gas injection pump that allows a decrease the overall production time. Gas injection pumps of the type depicted in U.S. Pat. Nos. 4,052,199 and 4,169,584, herein incorporated by reference, are the focus of this invention. In fact, the gas injection pumps described in these patents are significantly improved by the use of the present inventive discharge outlet.

As generally outlined above, the secondary production of aluminum alloys often requires the use of a reactive gas to lower magnesium content and/or an inert gas to remove inclusions and hydrogen. Moreover, in order to achieve a desired final magnesium specification for the materials being processed, magnesium removal must occur during the melt refining process. In many operations today, gas injection pumps are considered the most effective tool for this task.

Typically, chlorine is utilized in the treatment of molten aluminum containing undesirable magnesium levels. More particularly, degassing of the molten aluminum with chlorine has the following result:

$$2Al + 3Cl_2 \rightarrow 2AlCl_3\ (g)$$
$$2AlCl_3 + 3Mg \rightarrow 3MgCl_2 + 2Al$$
$$Mg + Cl_2 \rightarrow MgCl_2\ (l)$$

As can be seen, the reaction of the molten aluminum with chlorine ultimately results in the formation of magnesium chloride which collects as a dross on the surface of the molten aluminum in the furnace and can be skimmed away.

Generally, those skilled in the art determine the effectiveness of reactivity by assessing the amount of chlorine which can be introduced into the molten aluminum per unit time. In this context, the maximum amount of chlorine solubilized in the molten aluminum per unit time is readily determinable because aluminum chloride gas which is not reactively scavenged by the magnesium evolves to the surface and decomposes to hydrogen chloride which is visible as a white vapor when in contact with moist air. Under extremely poor reaction conditions, chlorine itself may not be scavenged by the aluminum and can also be directly emitted from the bath. Given the potential for environmental damage and the hazardous nature of chlorine and hydrogen chloride gases, such results are highly undesirable.

Accordingly, commercial gas injection pumps are operated at a level to prevent such emissions. Prior to the present invention, the primary mechanism for increasing the quantity of chlorine reacted and the corresponding rate at which the magnesium level is reduced, was to operate the pump at higher speeds. Of course, this proves very stressful on the dynamic components of the pump.

SUMMARY OF THE INVENTION

Accordingly, it is a primary object of this invention to provide a new and improved gas injection pump.

It is an advantage of this invention to provide a new and improved gas injection pump which allows for more efficient chemical treatment of molten aluminum, zinc or alloys containing these elements.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the pump of this invention comprises a housing which provides a chamber for containing a molten metal. The housing includes an inlet passage to the chamber and an outlet passage from the chamber which includes a nozzle. A rotatable impeller is disposed within the chamber. Rotation of the impeller draws molten metal into the chamber through the inlet passage and expels molten metal from the chamber through the outlet passage. A gas injection conduit having an inlet end in fluid communication with a source of purifying gas and an outlet end in proximity to the housing is also provided. Importantly, the outlet end of the gas injection conduit is located upstream of the nozzle in the outlet passage of the pump. In this context, the term upstream includes any point of injection into the molten metal flow which is before or within the nozzle area. Preferably, the gas injection conduit outlet is positioned adjacent the inlet passage to the chamber or is in fluid connection with the chamber itself. More preferably, the gas injection conduit outlet is in fluid connection with the chamber outlet passage. In a further preferred form of the invention, a connector is interposed between the gas injection conduit outlet and the outlet passage.

BRIEF DESCRIPTION OF THE DRAWINGS

The invention consists in the novel parts, construction, arrangements, combinations and improvements shown and described. The accompanying drawings, which are incorporated in and constitute a part of the specification illustrate one embodiment of the invention and, together with a description, serve to explain the principles of the invention.

Of the Drawings.

DETAILED DESCRIPTION OF THE INVENTION

While the invention will be described in connection with the preferred embodiment, it is to be understood that it is not intended to limit the invention to that embodiment. On the contrary, it is intended to cover all alternatives, modifications and equivalents as may be included within the spirit and scope of the invention defined by the appended claims.

Figure 1:
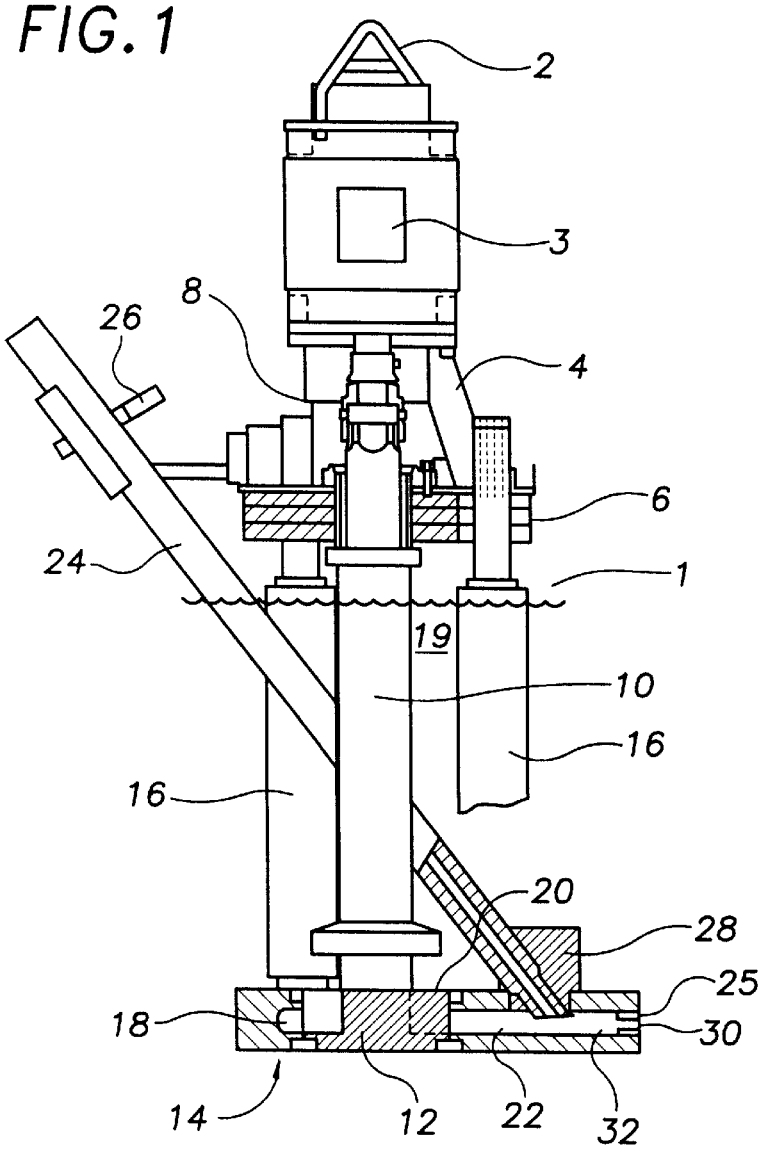
FIG. 1 is a side elevation view, partially in cross section, of a molten metal gas injection pump of the present invention.
Figure 7:
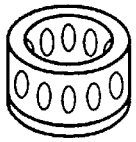
FIG. 7 is a perspective view of one impeller type used in testing of the present inventive design.
Figure 2:
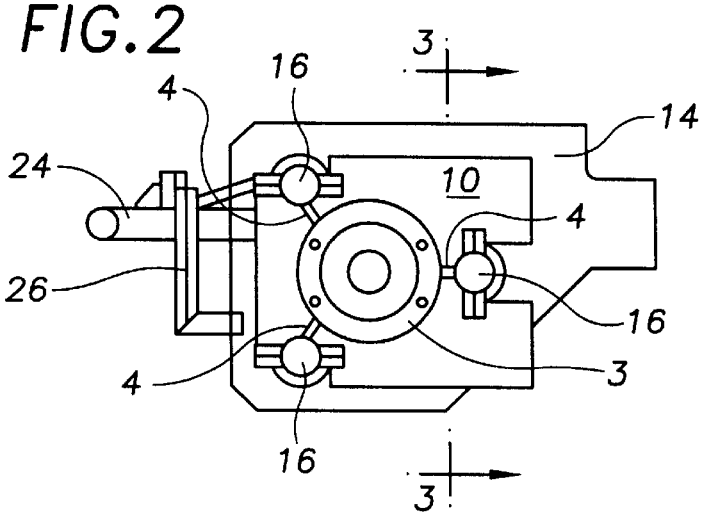
FIG. 2 is a top view of the pump of FIG. 1.

Referring now to FIG. 1, a typical gas injection pump 1 is depicted. Particularly, the pump 1 includes a hanger assembly 2 used for lifting and positioning of the pump as necessary within a furnace (not shown). A motor 3 is supported by a motor mount 4, itself supported by a support plate 6. The motor 3 is connected via a coupling assembly 8 to a rotatable shaft 10 secured to an impeller 12.

A base assembly 14 rests on the floor of a refractory furnace and forms a foundation for the support plate 6 and motor mount 4 by a plurality of posts 16. The impeller 12 is rotatable within a pumping chamber 18 and it's rotation draws molten metal 19 into the pumping chamber 18 through an inlet 20 and discharges the molten metal through an outlet passage 22.

A reactive gas is provided to a gas injection tube 24 supported by a clamping mechanism 26 attached to the support plate 6. The submerged end of the gas injection tube 24 is connected via a tube plug 28 to the outlet passage 22. Adjacent the discharge opening 30 of the outlet passage 22 is a convergent nozzle 25. Particularly, the outlet "necks down" to form an area of restriction 32 (a "zone of convergence") injection point. This restriction is more particularly shown in FIG. 3 where a cross section of the base is shown.

Although the depicted design places the nozzle 25 adjacent the opening 30, the inventive pump is equally functional when the nozzle is positioned further "upstream" in the outlet passage, i.e., closer to the pumping chamber, provided the gas injection point remains upstream. In such a design, the nozzle becomes a convergent-divergent type within the outlet passage. Further, although the base assembly 14 is shown as a substantially one-piece unit, it is expected that at least the outlet passage section may be a separate component/extension secured to the main body.

Figure 6:
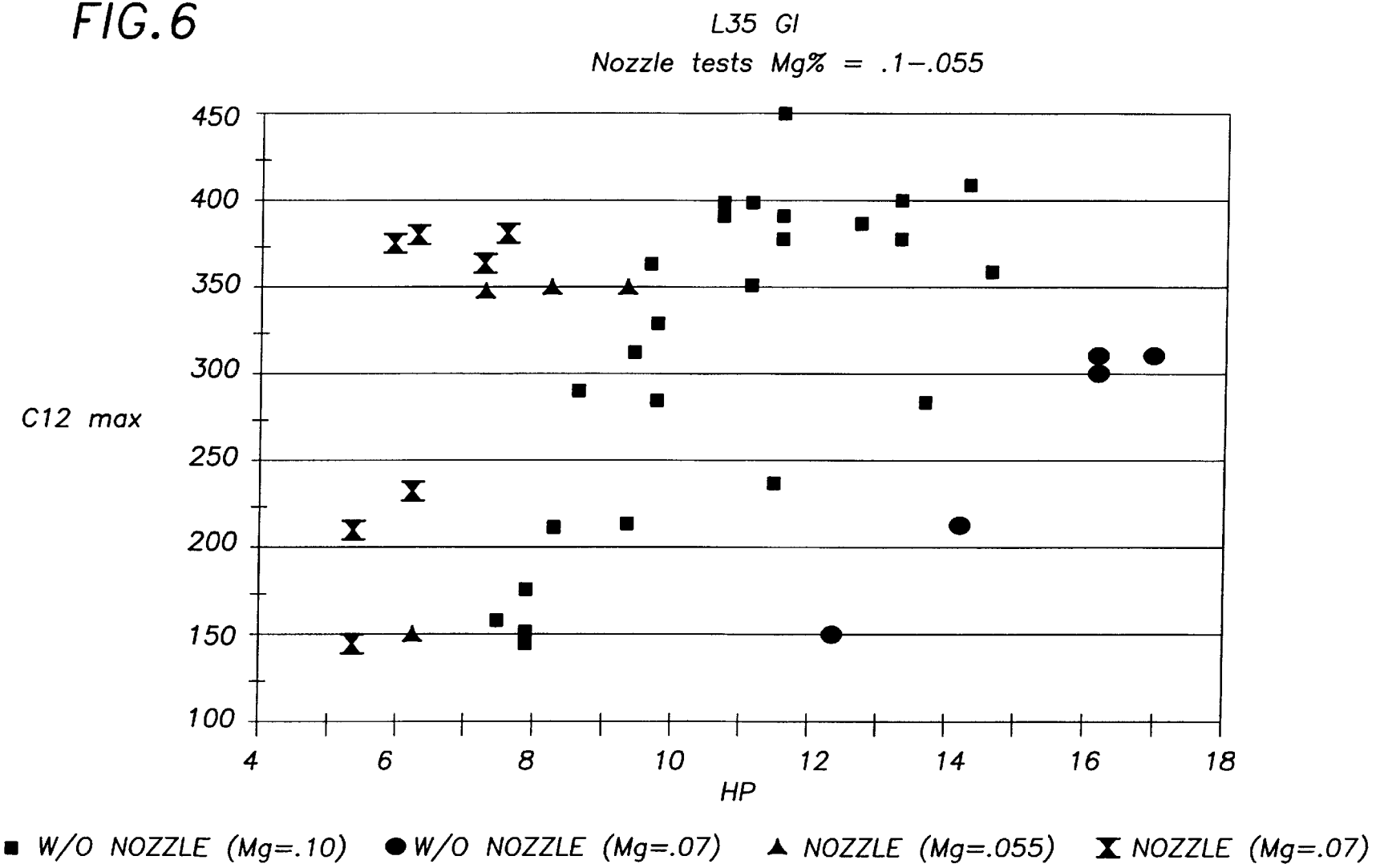
FIG. 6 is a graphical representation of chlorine gas injection rates demonstrating the effectiveness of the present inventive design relative to gas injection pumps without the nozzle.
Figure 8:
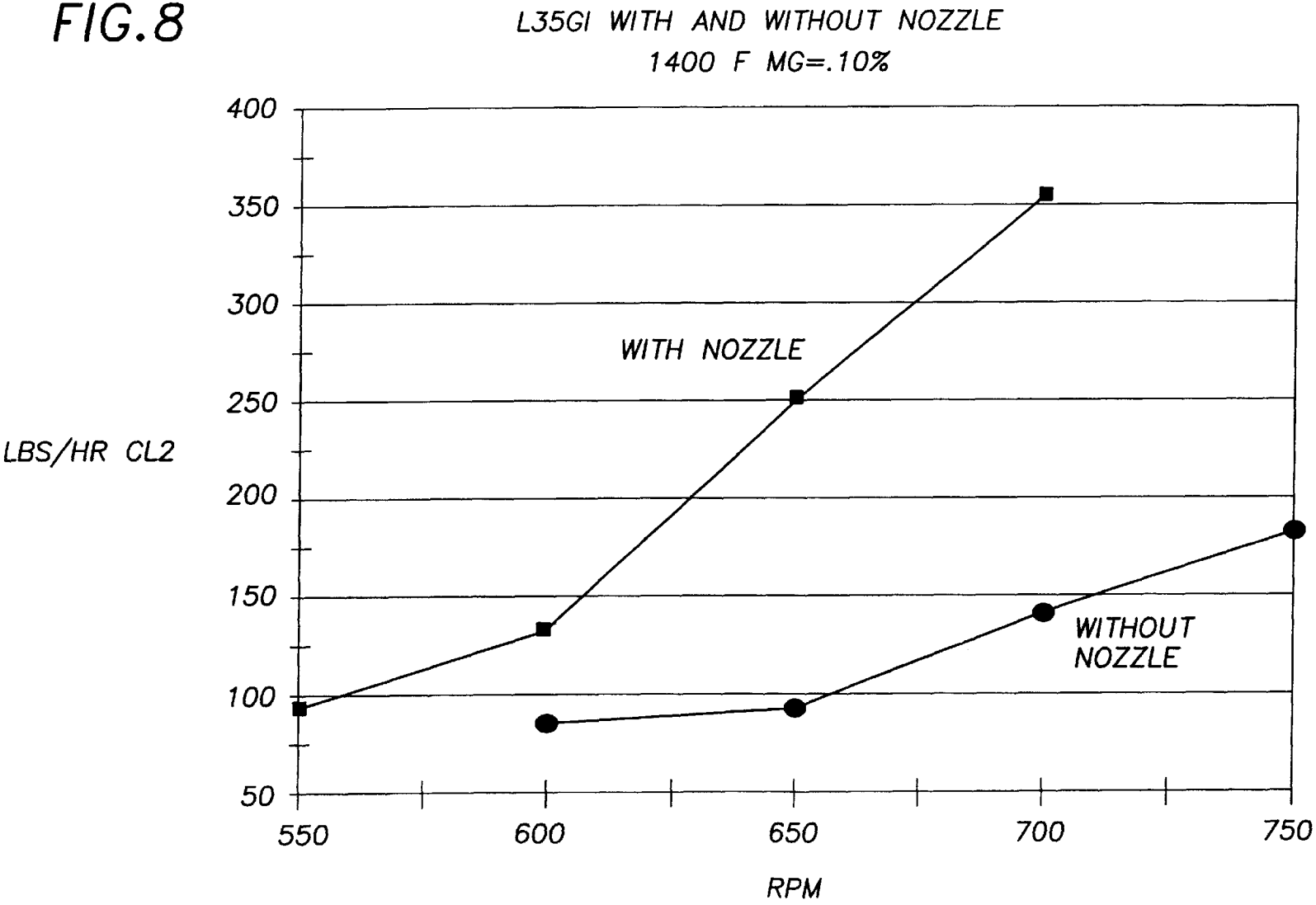
FIG. 8 is a graphical representation of chlorine gas injection rate versus motor speed.

Surprisingly, it has found that the present inventive design results in significant increase in maximum chlorine reacted and therefore, the rate at which magnesium can be removed from the molten aluminum. Attached as FIG. 6 is a graph showing the quantity of chlorine which is solubilized into the molten aluminum at a variety of speeds of operation of a Metaullics System Co., L.P. L35 gas injection pump. A similar comparison is provided by FIG. 8 wherein chlorine injection relative to pump speed (RPM) is shown. As is clear from the graphs, the inventive discharge nozzle allows significantly larger quantities of chlorine to be chemically absorbed by the molten aluminum at all levels of tested pump speeds.

Without being bound by theory, it is believed that the nozzle increases the velocity of the aluminum after the gas has been injected. The mixture of the gas and aluminum then is discharged into the charge well in a high speed jet resulting in high power turbulence and therefore better degassing and demagging. In the convergent-divergent design, the diverting section allows for a controlled reaction zone before expulsion into the bath while maintaining an intimate gas metal mixing zone, i.e. the zone of convergence. This embodiment is exemplified in FIG. 3 by the line A—A, where the nozzle could be positioned to form a convergent-divergent nozzle within the outlet passage and allows for the gas injection to occur at the location of metal divergence, i.e., just downstream of the nozzle yet within the outlet passage.

Hereinbelow is Table 1, depicting test results of various gas injection pumps operating with different impellers of the types described in U.S. Pat. No. 5,470,201 (impeller 1), and U.S. Ser. No. 60/018,216 (impeller 2), each of which are herein incorporated by reference, and in FIG., 7 (impeller 3). As a review of Table 1 will show, a gas injection pump fitted with the inventive nozzle design consistently results in an unexpected rise in the quantity of chlorine which can be solubilized by the molten aluminum.

TABLE 1

| RPM | AMPS | CL2 | MG % | TEMP | |
|---|---|---|---|---|---|
| IMPELLER 1 WITH NOZZLE | | | | | |
| 700 | 14 | 340 | 0.04 | 1345 | Light puffs |
| 650 | 16 | 290 | 0.04 | 1344 | Light puffs |
| 600 | 15 | 195 | 0.04 | 1344 | Clear |
| 550 | 14.5 | 180 | 0.04 | 1344 | Clear |
| 500 | 13.5 | 175 | 0.04 | 1344 | Very light puffs |
| 450 | 12.5 | 130 | 0.04 | 1344 | Clear |
| 400 | 11.5 | 90 | 0.04 | 1344 | Clear |
| IMPELLER 1 WITHOUT NOZZLE | | | | | |
| 700 | 20.5 | 200 | 0.055 | 1372 | Maximum |
| 650 | 18 | 165 | 0.055 | 1372 | Maximum |
| IMPELLER 2 WITH NOZZLE | | | | | |
| 700 | 19 | 380 | 0.10 | 1470 | Not Maximum |
| 650 | 17.5 | 355 | 0.10 | 1470 | Maximum |
| 600 | 16 | 300 | 0.10 | 1470 | Maximum |
| 550 | 15 | 135 | 0.10 | 1470 | Maximum |
| 500 | 14 | 95 | 0.10 | 1470 | Maximum |
| IMPELLER 2 WITHOUT NOZZLE | | | | | |
| 700 | 22 | 180 | 0.10 | 1485 | Maximum |
| 650 | 19 | 145 | 0.10 | 1485 | Maximum |
| 600 | 17 | 95 | 0.10 | 1485 | Maximum |
| 550 | 16 | 85 | 0.10 | 1485 | Maximum |
| IMPELLER 3 WITH NOZZLE | | | | | |
| 700 | 23 | 250 | .03 | 1460 | Maximum |
| 650 | 22 | 210 | .03 | 1460 | Maximum |
| 600 | 20 | 155 | .03 | 1460 | Maximum |
| 550 | 19 | 120 | .03 | 1460 | Maximum |

TABLE 1-continued

| RPM | AMPS | CL2 | MG % | TEMP | |
|---|---|---|---|---|---|
| 500 | 18 | 95 | .07 | 1460 | Maximum |
| IMPELLER 3 WITHOUT NOZZLE | | | | | |
| 700 | 26 | 210 | .07 | 1460 | Maximum |
| 650 | 24 | 170 | .07 | 1460 | Maximum |
| 600 | 22 | 150 | .07 | 1460 | Maximum |
| 550 | 20 | 115 | .07 | 1460 | Maximum |
| 500 | 18 | 95 | .07 | 1460 | Maximum |

As stated above, reduction in magnesium levels is a critical step in aluminum refining. Since the inventive molten metal gas injection pump results in significant increase in chlorine injection and hence a more rapid reduction in magnesium levels, the present invention is highly advantageous.

Similarly, as those skilled in the art will understand, the typical mechanism for increasing chlorine injection rates is to increase the speed of pump operation. With the present invention, aluminum refiners are able to run molten aluminum pumps at slower speeds yet obtain higher rates of chlorine reaction. Since pumps include dynamic pieces of equipment which can experience failure, this less stressful operation will provide significant advantages to the refiners.

In addition, it is noted that the prior art gas injection pump design often requires very long discharge tubes that clog with dross and other scrap. In contrast, the present design requires a much shorter outlet nozzle which can be readily cleaned when the pump is removed from the molten aluminum environment.

Figure 5:
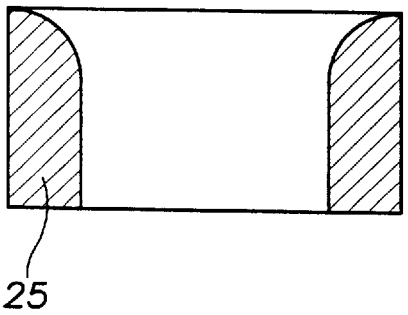
FIG. 5 is a cross-sectional view of FIG. 4, taken along lines 5—5.
Figure 4:
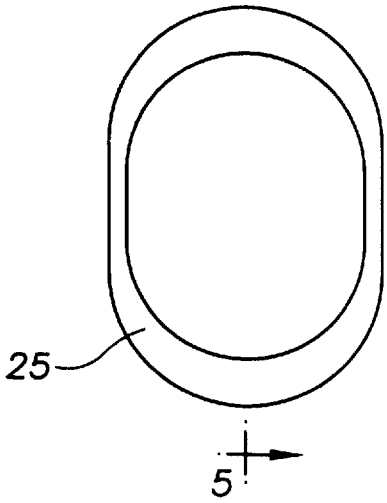
FIG. 4 is a side elevation view of a nozzle creating insert.
Figure 3:
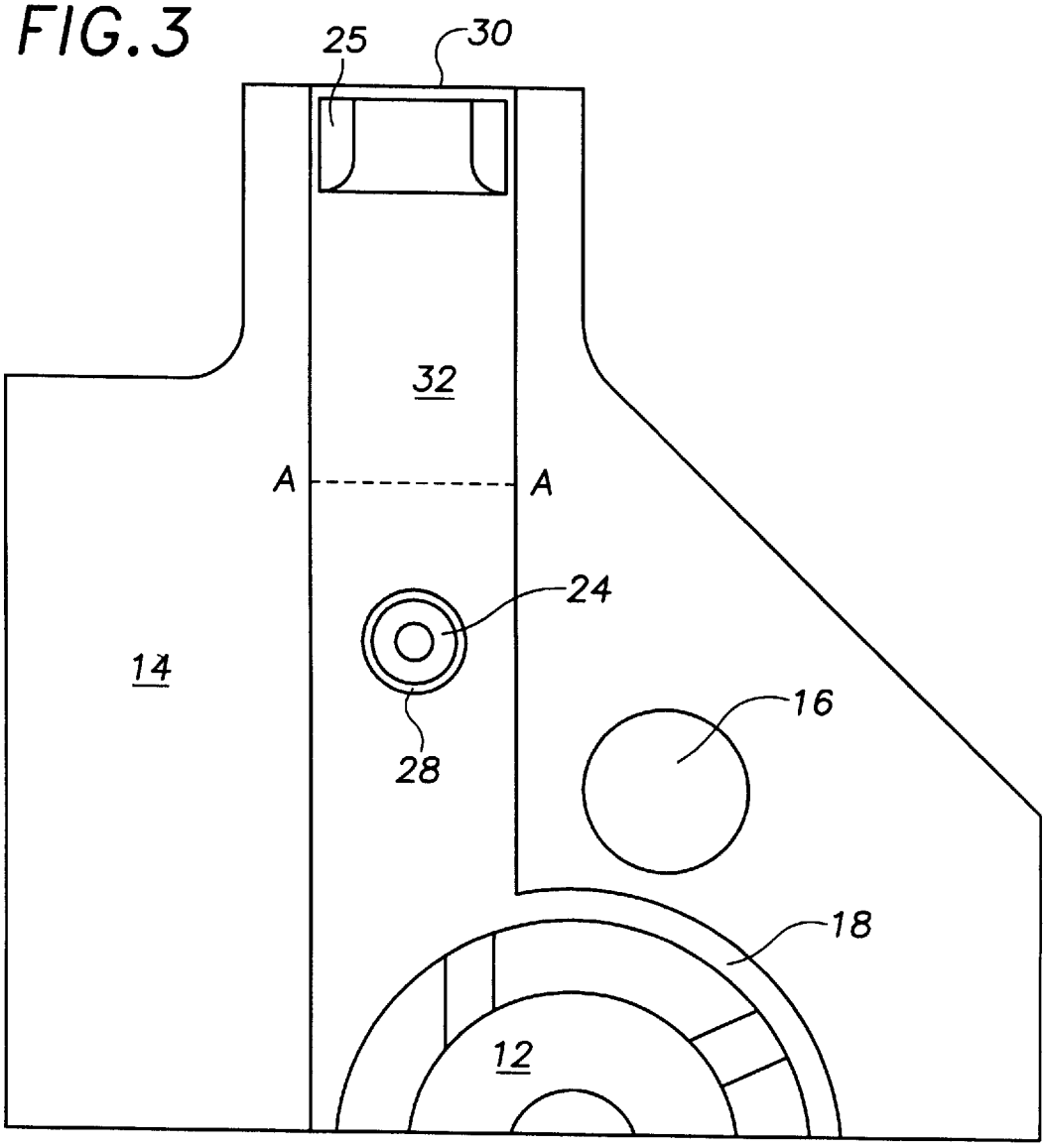
FIG. 3 is a detailed view of a section of the base taken along line 3—3 of FIG. 2, particularly showing the outlet passage including the nozzle.

Furthermore, the nozzle modification is easily accomplished at a low cost. Particularly, as shown in FIG. 3, one option is to include a separate nozzle 25 (FIGS. 4 and 5), cemented into a traditional discharge outlet. Alternatively, the discharge can be machined as a one-piece unit having a reduced diameter downstream of the gas injection point.

Thus, it is apparent that there has been provided, in accordance with the invention, a gas injection pump that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed:

1. An apparatus for treating molten aluminum or zinc comprising:

a) a housing providing a chamber for containing a molten metal, said chamber including an inlet opening and an outlet passage;

b) a rotatable impeller disposed within said chamber for drawing molten metal in through said inlet opening and expelling molten metal through said outlet passage and creating a flow of molten metal generally from said inlet opening to said outlet passage, said outlet passage including a nozzle having a convergent inlet and a divergent outlet wherein said angle of said divergent outlet is greater than the angle of said convergent inlet; and c) a gas injection conduit having an inlet in fluid communication with a source of purifying gas and an exit in proximity to said chamber, said gas injection conduit exit being positioned upstream of said nozzle.

2. The apparatus of claim 1 wherein said gas injection conduit is comprised of a material chemically resistant to chlorine gas.

3. The apparatus of claim 1 wherein said conduit exit is positioned within said chamber.

4. The apparatus of claim 1 wherein said conduit exit is positioned within said chamber outlet passage.

5. The apparatus of claim 1 wherein said conduit exit is positioned within said nozzle.

6. The apparatus of claim 1 being comprised substantially of graphite or ceramic.

7. The apparatus of claim 1 wherein said outlet passage includes a convergent-divergent nozzle upstream of a final opening of said outlet passage into a molten metal bath.

8. The apparatus of claim 1 wherein said outlet passage includes said nozzle adjacent a final opening of said outlet passage into a molten metal bath.

9. The apparatus of claim 1 wherein said nozzle is formed as an integral element of said outlet passage.

10. The apparatus of claim 1 wherein said nozzle is formed as an insert secured within said outlet passage.

11. The apparatus of claim 1 wherein said outlet passage is formed by a separate element secured to said housing.

12. The apparatus of claim 2 wherein said gas injection conduit is secured to said housing via a connector member.

13. The apparatus of claim 7 wherein the gas injection conduit exit is in a divergent zone downstream of said nozzle within said outlet passage.

14. An apparatus for treating molten aluminum or zinc comprising:

a) a housing providing a chamber for containing a molten metal, such chamber including an inlet opening and outlet passage;

b) a rotatable impeller disposed within said chamber for drawing molten through said inlet and expelling molten metal through said outlet passage, said outlet passage including a convergent nozzle, said convergent nozzle including a terminal downstream portion which allows for substantially immediate expansion of said molten metal to the walls of the outlet passage or the exterior of said outlet passage and;

c) a gas injection conduit having an inlet in fluid communication with a source of purifying gas and an outlet in proximity to said chamber, said gas injection conduit being positioned upstream of said nozzle.

* * * * *